United States Patent [19]

King et al.

[11] 4,280,350

[45] Jul. 28, 1981

[54] WIRE BENDING SYSTEM

[75] Inventors: James F. King, Winston-Salem; Gilbert L. Horton, Kernersville, both of N.C.

[73] Assignee: Consolidated Foods Corporation, Winston-Salem, N.C.

[21] Appl. No.: 101,727

[22] Filed: Dec. 10, 1979

[51] Int. Cl.[3] ..... B21D 7/14; B21D 7/08

[52] U.S. Cl. ..... 72/7; 72/12; 72/14; 72/215; 140/71 R

[58] Field of Search ..... 72/6–12, 72/14, 26, 215; 140/71 R

[56] References Cited

U.S. PATENT DOCUMENTS

| | | | |
|---|---|---|---|
| 3,393,543 | 7/1968 | VanGelder | 72/26 |
| 3,821,525 | 6/1974 | Eaton et al. | 72/8 X |
| 3,955,389 | 5/1976 | Foster | 72/9 |
| 4,080,815 | 3/1978 | Foster | 72/168 |

*Primary Examiner*—Milton S. Mehr

*Attorney, Agent, or Firm*—Charles Y. Lackey; William S. Burden

[57] ABSTRACT

A system for automatically bending wire into arcuate segments of different selected configurations utilizing a wire bending roll displaceable selectively by a stepping motor which is controlled by a microprocessor to bend a length of wire conforming to data retrieved from a computer. The wire is selectively advanced to a shear assembly where it is severed to a specific length and advanced through feed rolls towards the bending roll. Detection of the advancing severed length of wire locks in a strobe gear and the microprocessor with the stepping motor to determine the position of the wire with respect to the bending roll and to incrementally displace the bending roll in a controlled manner along an arcuate path to produce the desired bend in the wire.

10 Claims, 15 Drawing Figures

WIRE BENDING SYSTEM

BRIEF SUMMARY AND OBJECTS OF THE INVENTION

This invention relates generally to a system for automatically bending wire into arcuate segments of different selected configurations, and more particularly to a system for selectively forming reinforcing frames for use in ladies'brassieres.

Breast supporting wire frames are generally of semicircular form which are stitched into a garment to impart rigidity thereto. The support frame is formed of resilient wire of rectangular cross section having its longer dimension extending radially with respect to the curvature of the support frame thus providing a greater degree of lateral flexibility while at the same time providing resistance of the frame ends toward and away from each other. The wire frame subsequently may be encompassed within plastic or other suitable material and/or provided with protective tips or caps at the ends thereof.

Briefly, in the present system, a selected wire frame sample having the desired arcuate configuration is placed upon a graphic device, which may be of the type disclosed in U.S. Pat. No. 3,838,212, and the configuration of the frame is traced using a suitable stylus, such as a spark pen. In this manner, the pattern of the sample frame is digitized by the graphic device and is analyzed to provide control data to be fed to a microprocessor which controls the bending of a length of wire to a configuration conforming to the sample. The data may be fed to a computer memory for storage and subsequent retrieval, as desired. The specific configurations of a plurality of wire frame samples may be stored in the computer in this manner.

The wire frames are formed by advancing wire from a supply source to a shear mechanism where the wire is cut into specificed lengths for subsequent bending into a desired arcuate configuration conforming to a specific wire sample. After severing. a wire segment is advanced by feed rolls to a wire bending station. As the forward end of the severed segment enters the bending station, a stepping motor receives signals from a control system, which includes the microprocessor and computer, for incrementally displacing a bend roll along an arcuate path in a controlled manner to produce a wire segment having the desired contour.

One of the primary objects of the invention is the provision of a new and improved system for forming wire segments into support frames having selected, prescribed configurations.

Another object of the invention is the provision of a new and improved system for bending wire members into prescribed, arcuate configurations.

Still another object of the invention is the provision of a wire bending system which is arcuate and reliable in operation.

A further object of the invention is the provision of a wire bending system which uses stored bend data for automatically controlling and deforming the wire segments to specific, desired configurations.

Other objects and advantages of the invention will become apparent when considered in view of the following detailed description.

DETAILED DESCRIPTION OF THE INVENTION

Figure 4:
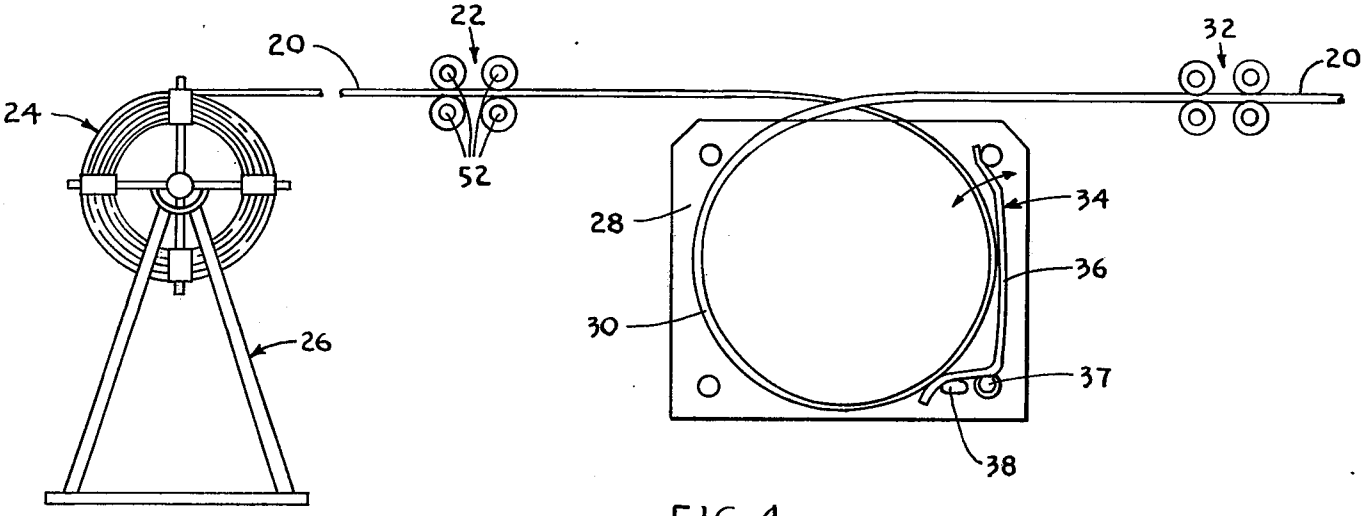
FIG. 4 is an enlarged, fragmentary, schematic side elevational view of the mechanism for supplying wire to the shear assembly.

Referring to the drawing, the wire 20, having a rectangular cross-section, is advanced by a first series of feed rolls 22 from a supply coil 24 mounted upon a stand 26 into a housing 28 where the wire forms a lazy loop 30 before continuing to a second series of feed rolls 32. The housing 28 confines the wire loop and houses a loop detector 34, FIG. 4, for controlling operation of the first series of feed rolls.

Figure 2:
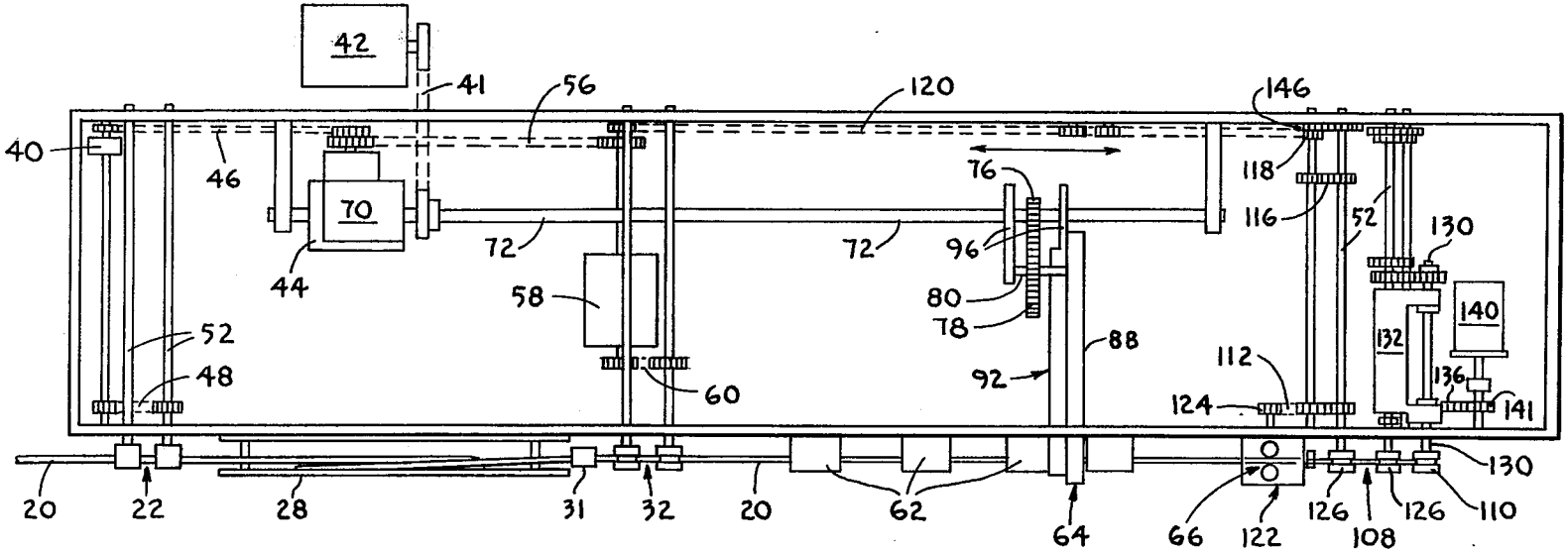
FIG. 2 is a schematic, fragmentary, top plan view with parts removed for clarity of the apparatus of FIG. 1.
Figure 3:
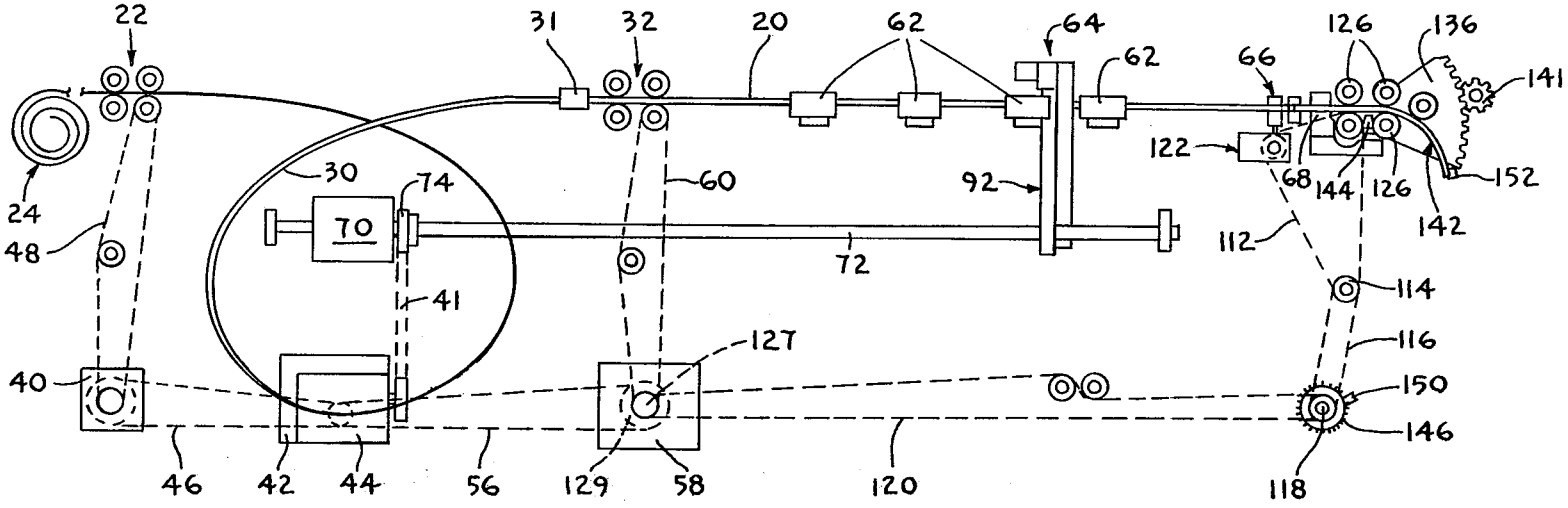
FIG. 3 is a schematic, fragmentary, side elevational view of the apparatus illustrating movement of the wire through the apparatus.

The loop detector 34 includes an arm 36 pivoted at 37 to the housing and is normally gravity biased into engagement with the wire forming the loop. A mercury switch 38 is attached to the loop detector arm and controls the operation of the first series of feed rolls 22 through an analog clutch 40. The feed rolls 22 are driven by a motor 42 through a belt 41, a gear transmission 44, first and second chains 46 and 48 and a gearing assembly 50, FIG. 5. The gearing assembly 50 has been omitted from FIGS. 1–3 for clarity. The chain 48 rotates the gear assembly 50, which includes four shafts 52, each having a feed roll secured thereto. As the wire loop diminishes in size, the arm 36 pivots and mercury switch 38 activates the clutch 40 to drive the feed rolls 22 and advance more wire into the housing to increase the size of the wire loop. The loop detector 34 deactivates the clutch when the wire loop increases to a predetermined size.

Figure 6:
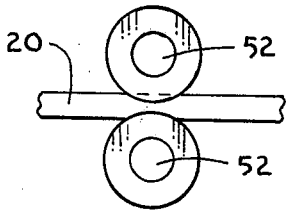
FIG. 6 is an enlarged, side elevational view of cooperating wire feed rolls.
Figure 7:
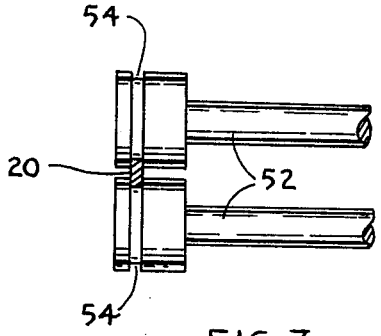
FIG. 7 is an enlarged end elevational view of the feed rolls and wire of FIG. 6.

Within the housing 28, the wire forming the loop rotates approximately 90° from a position with the major cross-sectional dimension extending generally in a horizontal plane as it passes between the opposed pairs of the first series of feed rolls 22, to a position with the major cross-sectional dimension extending generally in a vertical plane where it passes through a guide 31 before reaching the second series of feed rolls 32. Each roll of the second series of feed rolls 32 is provided with a groove 54 therein for receiving, guiding and advancing the wire, as shown by FIGS. 6 and 7. The width of the grooves substantially corresponds to the thickness of the wire 20.

Figure 5:
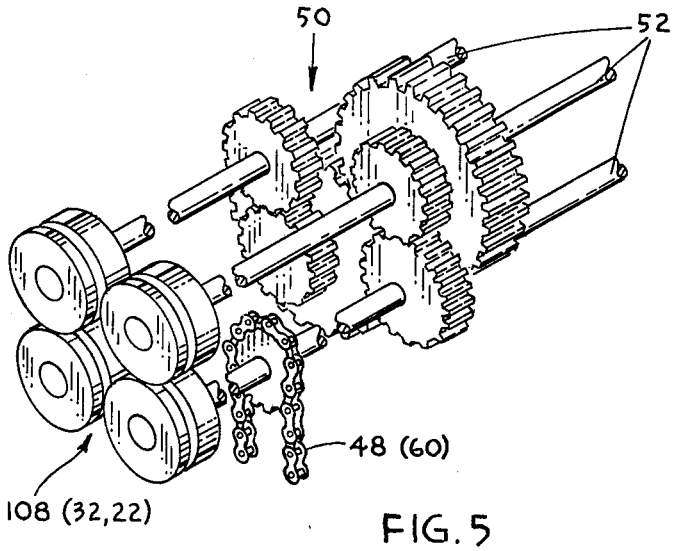
FIG. 5 is an enlarged, schematic view of a gear arrangement for driving the wire feed rolls.

The second series of feed rolls 32 is driven by a gear assembly of the type as shown by FIG. 5 which, in turn, is driven by the motor 42 through gear transmission 44, chain 56, a clutch-brake unit 58, which may be a Warner Electro Pack Model EP 250, and a chain 60. The second series of rolls 32 feeds the wire through the guides 62, which are adjustably mounted upon the machine frame, the shear assembly 64, and the scuffing rolls 66 until the end of the wire is advanced to the photocell 68 serves to disengage the clutch and actuate the brake of unit 58 to stop rotation of the feed rolls 32 and advancement of the wire.

The detection of the leading end of the wire by photocell 68 actuates a clutch 70 which rotates the square shaft 72 and drives the shear assembly 64 for severing the wire. The severed length of wire, which is a prescribed, preselected length, extends from the cutting element 100 of the shear assembly 64 through the scuffing rolls 66 and to the photocell 68.

The square shaft 72 normally is at rest but is driven by motor 42 through the belt 41 and pulley 74 upon actuation of the clutch 70. Rotation of the squared shaft 72 drives gears 76 and 78 of the shear assembly. The gear 78 is mounted upon a shaft 80 which has a disk 82 attached thereto. The disk 82, FIG. 8, carries an eccentrically mounted drive member 84, which extends into an elongated 86 provided in the shear arm 88. The arm 88 is pivoted about a pin 90 fixed to a support 92 of the shear assembly. The entire shear assembly 64 is supported upon the machine frame 94 for horizontal adjustment relative thereto to facilitate cutting of the wire to various pre-selected lengths. The gear 76, frame 96, and entire assembly 64 are slidable axially of the shaft 72.

Upon actuation of the clutch 70, the shaft 72 rotates, and through gearing 76, 78, the eccentric member 84 pivots the shear lever 88 about pin 90. In the specific embodiment illustrated, three revolutions of shaft 72 are required to pivot the shear lever 88 through one cycle.

Figure 9:
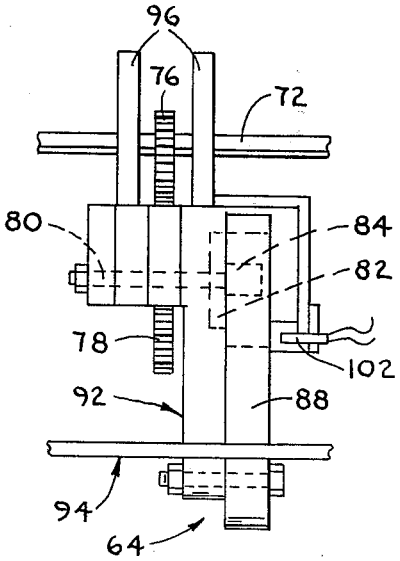
FIG. 9 is a top plan view of the shear assembly.
Figure 10:
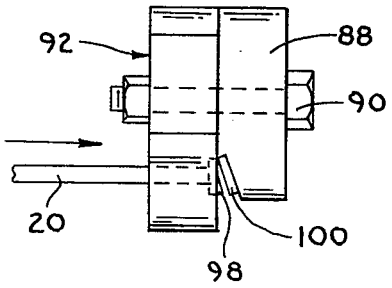
FIG. 10 is an enlarged, front elevational view of the cooperating wire cutting elements of the shear assembly.
Figure 8:
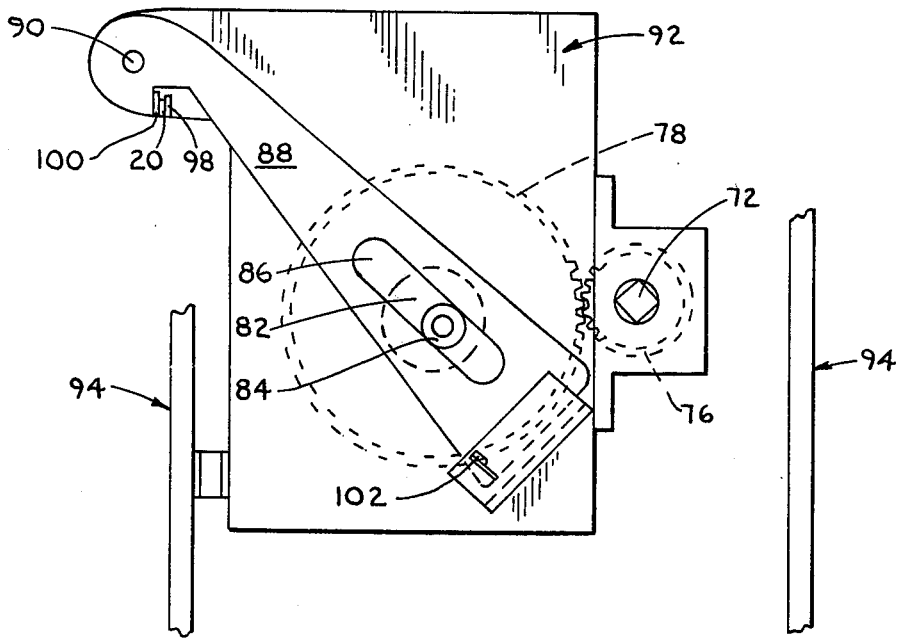
FIG. 8 is a side elevational view of the displaceable wire shear assembly.
Figure 11:
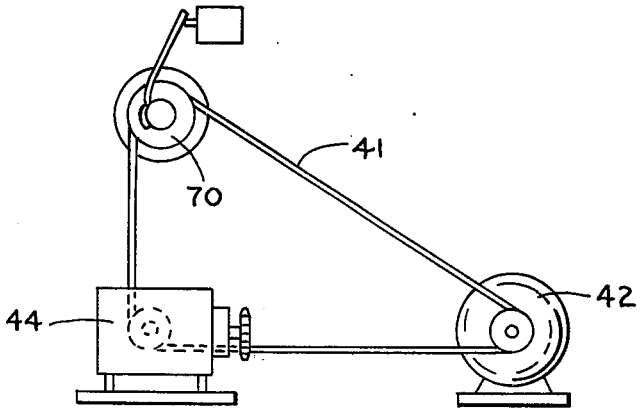
FIG. 11 is an elevational view of a portion of the drive arrangement including the clutch arrangement for driving the shear.

Referring to FIGS. 8 and 10, the support 92 is provided with a fixed cutting member 98 and the pivotable arm 88 is provided with a cutting member 100 which cooperate to sever the wire 20. During normal feeding of the wire, the wire passes between the two cutting members 98, 100, as shown by FIG. 8. Upon actuation of the clutch 70, rotation of shaft 72 pivots the lever 88 and member 100 relative to fixed member 98. A photocell 102, FIGS. 8 and 9, is positioned to sense the position of the shear lever 88 upon the completion of one cycle, thus deactivating the clutch 70.

The severed length of wire is advanced by the vertically disposed scuffing rolls 66 and by a third series of feed rolls 108 towards the bending roll 110. The third series of feed rolls is continuously driven by motor 42 through gearing, similar to that shown by FIG. 5, and through chain 112, sprocket 114, chain 116, sprockets 118, chain 120, sprockets 127, 129, chain 56 and belt 41. The scuffing rolls also are continuously driven through a gearbox 122 and sprocket 124 from the chain 112.

Figure 1:
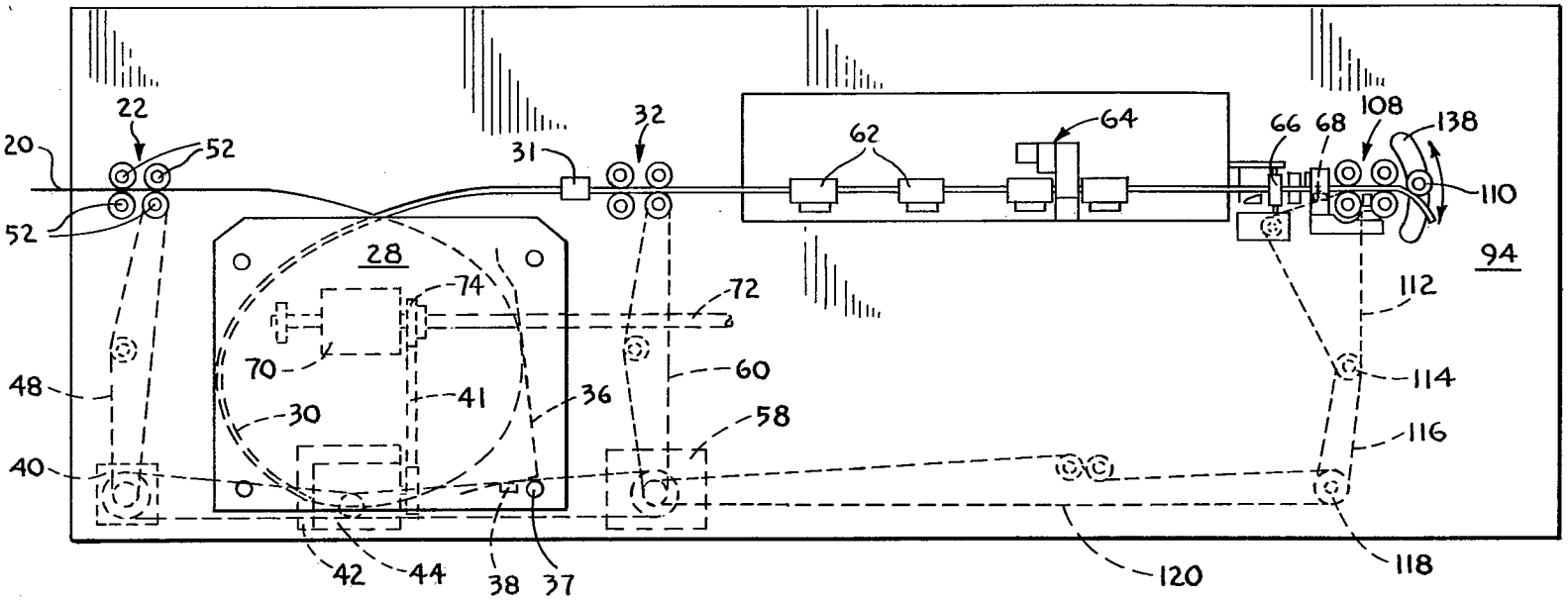
FIG. 1 is a schematic, fragmentary, side elevational view of the wire feeding, severing and bending apparatus of the present invention.
Figure 13:
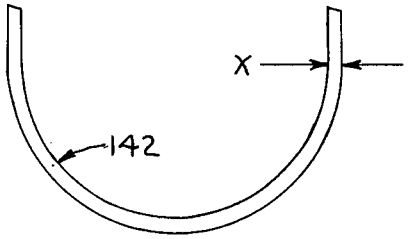
FIG. 13 is an elevational view of a wire support frame.
Figure 14:
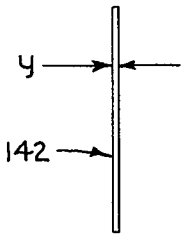
FIG. 14 is a fragmentary end elevational view of the wire support.
Figure 12:
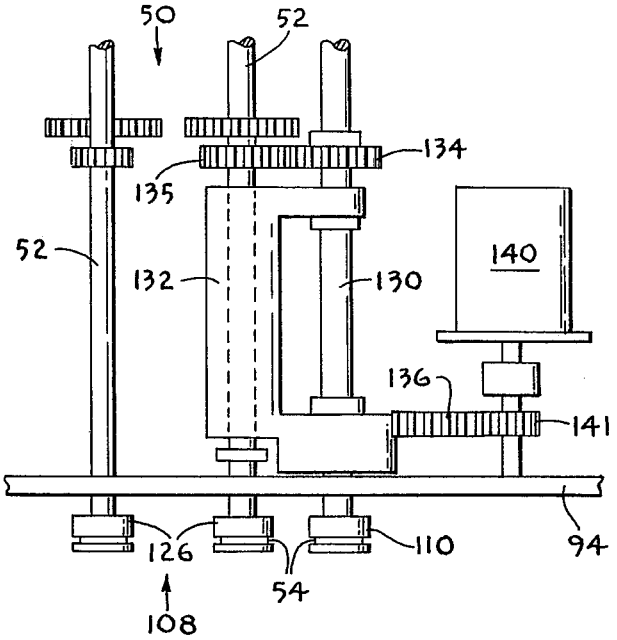
FIG. 12 is a fragmentary, enlarged, top plan view of the stepping motor arrangement for displacing incrementally the wire bending roll.
Figure 15:
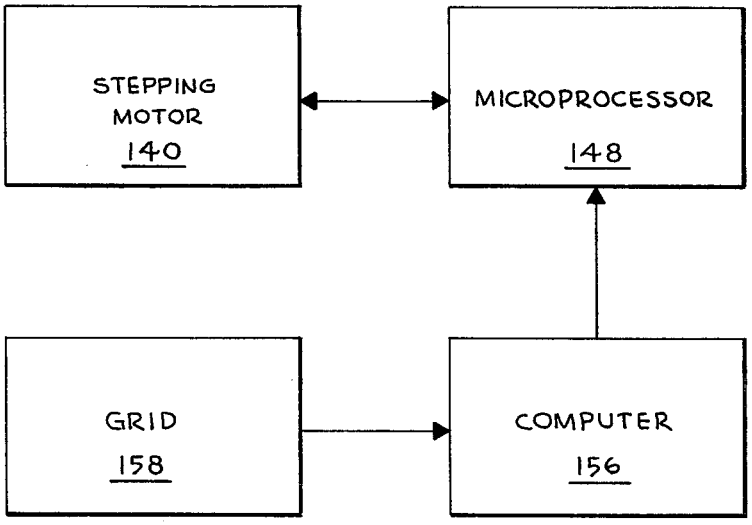
FIG. 15 is a simplified block diagram of various operational components of the wire bending system.

Referring to FIG. 12, the third series of rolls 108 includes two pairs of cooperating feed rolls 126, each having a groove 54 for receiving a severed length of wire and advancing the wire in a generally horizontal plane towards the bending roll 110. The bending roll 110 is fixedly secured to a shaft 130 rotably mounted in a support 132 which is pivoted upon the uppermost shaft 52 of the upper feed roll 126 closest thereto. The bending roll is driven by a gear 134 which engages a gear 135 of gear assembly 50 which drives the third series of feed rolls 108. The support 132 is adapted to be selectively reciprocated through a desired angle by a gear segment 136 secured to the support 132. Shaft 130 extends through an elongated arcuate slot 138 in the side frame 94 and is adapted to be selectively displaced in a controlled manner along an arcuate path within slot 138 by a stepping motor 140 which has a pinion 141 in meshing relation with the gear segment 136. The bending roll 138 also is provided with a wire slot or groove 54, and as a wire segment to be bent is advanced between the third series of rolls, the bending roll moves in a controlled manner to form an arc or bend in the wire, as shown by FIG. 1. Upon completion of the bend to the desired arcuate configuration, the resulting wire frame 142, as shown by FIGS. 13 and 14, is deposited upon a conveying mechanism, or within a receptacle, etc., as desired. During the bending operation the wire extending horizontally between the feed roller 126 is maintained in a vertical plane by the grooves 54, that is, the major cross-sectional dimension X of the wire frame extends radially with respect to the curvature of the frame, and the minor cross-sectional dimension Y extends perpendicular to the plane in which the arcuate frame 142 normally lies.

After a length of wire is severed by the shear assembly 64, it is advanced by the scuffing rolls 66 to the third series of feed rolls 108. A photocell 144 detects the advancing end of the severed wire and electronically locks in a strobe wheel or gear 146 and microprocessor 138 with the stepping motor 140. The strobe gear 146 is mounted for rotation with sprocket 118 and a photocell 150 senses or counts the teeth of the rotating strobe gear to, in effect, measure the length of or determine the position of the severed wire segment with respect to the bending roll 110. As the wire segment advances, the movable bending roll moves in an arc around the axis of rotation of the lower right hand feed roll 126, as shown by FIG. 1. This movement of the bending roll is controlled by the stepping motor 140 such that as the wire segment advances, the movement of the bending roll produces the desired bend in the wire segment. A photocell 152 is provided to sense the home position of the gear segment 136.

The operation of the stepping motor 140 may be controlled through the microprocessor 148 and computer 156. Data from a graphic device 158 can be fed to the memory of Computer 156 for temporary or permanent storage for retrieval as desired. By using the graphic device 158, computer 156 and microprocessor 148, bending data for a number of different specific configurations of arcuate wire members may be stored and selectively retrieved. In initially using the system, a brassiere underwire frame is positioned selectively upon the grid of the graphic device 158. The graphic device may be of the type as disclosed in U.S. Pat. No.

3,838,212, which is to be incorporated herein by reference. A prescribed underwire frame is positioned upon the grid of the graphic device 158 and a stylus or spark pen is used to trace the arcuate configuration of the wire frame. Upon movement of the stylus, periodic sparks generate sound waves which move to first and second receivers. Computing means are employed to determine the positional coordinates of the stylus in response to the transit time of the sound waves between the stylus and the receivers, and the shape or arcuate configuration of the frame is stored in the computer. The specific configurations of a plurality of underwire frames can be stored in the computer in this manner for later recall.

When the roll 110 is to bend a wire segment into a specific configuration, the stored information for that specific configuration is retrieved from the computer and directed to the microprocessor which controls the stepping motor 140 to displace selectively the gear segment 136 having the bending roll 110 positioned thereon.

Normally, the bent wire segment has a tendency to springback, to a degree, toward its original shape. Upon determining the approximate amounte of springback for each configuration of the segments 142, the computer memory may be programmed to compensate for springback by slightly overbending the wire, thus resulting in the final configuration of a specific wire segment corresponding to the configuration of a wire frame originally traced by a stylus upon the grid of the graphic device. U.S. Pat. Nos. 3,955,389 and 3,821,525 disclose means for providing for springback compensation.

What is claimed is:

1. Apparatus for contour forming a length of wire having a rectangular cross-section into discrete wire frames having predetermined arcuate sections, with the major cross-sectional dimension of each wire frame extending radially with respect to the curvature of the arcuate sections comprising; support frame means, means for selectively advancing a length of wire along a prescribed path, means for sequentially severing the advancing wire to form elongated, discrete wire segments, each having a prescribed, preselected length, means for sequentially feeding each wire segment in a direction longitudinally of the segments, means for sensing the longitudinal displacement of each wire segment and for selectively bending at least portions of each wire segment about its longitudinal axis in a controlled manner into a frame, having a prescribed, preselected configuration.

2. Apparatus as recited in claim 1, said severing means including a displaceable shear lever, means for detecting the end of an advancing wire segment, and clutch means driving said shear lever to sever the wire upon detection by said detecting means.

3. Apparatus as recited in claim 1, wherein said means for sensing the displacement of a wire segment and for selectively bending the segment includes a rotatable bending roll and means for selectively and incrementally displacing said bending roll along an arcuate path in a controlled manner to produce a wire frame having the desired contour.

4. Apparatus as recited in claim 3, wherein said means for selectively and incrementally displacing said bending roll along an arcuate path includes a stepping motor and a microprocessor which controls the segment bending roll in response to control data stored within a computer.

5. Apparatus as recited in claim 4, wherein said feeding means includes a series of pairs of cooperating feed rolls, at least two pairs of said series of pairs of cooperating feed rolls defining opposed, radially extending grooves therein for receiving and retaining an advancing wire segment with the major cross-sectional dimension of the wire extending in a vertical plane, and said bending roll defining a wire receiving slot therein aligned with said grooves for receiving at least a portion of said wire segment.

6. Apparatus as recited in claim 5, and further including means for continuously driving said series of pairs of cooperating feed rolls and said bending roll.

7. Apparatus as recited in claim 4, said means for selectively and incrementally displacing said bending roll further includes a sensor apparatus for detecting the advancing end of the severed wire.

8. Apparatus as recited in claim 4, wherein said feeding means includes at least two pairs of cooperating feed rolls, said means for selectively and incrementally displacing said bending roll further including a support pivotably mounting said bending roll for displacement in an arc about the axis of rotation of one feed roll of said two pairs of cooperating feed rolls, said support having a gear segment fixed thereto and displaceable by said stepping motor.

9. Apparatus as recited in claim 8, and further including means for facilitating rotation of the length of wire a selected angle about its longitudinal axis, and sensor means for selectively controlling said advancing means.

10. The method of sequentially forming wire frames from a length of wire of rectangular cross-section into generally semi-circular configurations with the longer dimension of the rectangular cross-section extending radially with respect to the curvature of the support frames comprising the steps of; selectively advancing a length of wire along a prescribed path, sensing the advancing end portion of the wire, severing the forward portion of the wire to a prescribed length in response to sensing of the wire end, feeding the severed wire segment along a predetermined path, detecting the advancing end portion of the severed wire segment, and deforming the advancing wire segment in a prescribed, controlled manner in response to bend data control signals related to a preselected curvature, to incrementally deform the segment to a generally semi-circular configuration.

* * * * *